US006986590B1

(12) United States Patent
Padden

(10) Patent No.: US 6,986,590 B1
(45) Date of Patent: Jan. 17, 2006

(54) ARTICULATED LIGHT

(76) Inventor: Stephen J. Padden, 120 Shamrock Dr., Ventura, CA (US) 93003

( * ) Notice: Subject to any disclaimer, the term of this patent is extended or adjusted under 35 U.S.C. 154(b) by 0 days.

(21) Appl. No.: 10/652,014

(22) Filed: Aug. 29, 2003

Related U.S. Application Data

(60) Provisional application No. 60/407,801, filed on Sep. 4, 2002.

(51) Int. Cl.
*F21L 4/00* (2006.01)

(52) U.S. Cl. ..... 362/197; 362/116; 362/398; 362/421

(58) Field of Classification Search ..... 362/103, 362/104, 110, 111, 116, 118, 119, 120, 157, 362/197, 200, 208, 250, 269, 282, 287–289, 362/397, 398, 421, 422, 427, 517, 578
See application file for complete search history.

(56) References Cited

U.S. PATENT DOCUMENTS

| | | | | | |
|---|---|---|---|---|---|
| 1,741,264 | A * | 12/1929 | Wappler | 362/105 |
| 2,117,967 | A * | 5/1938 | Leipold et al. | 362/105 |
| 3,008,040 | A * | 11/1961 | Moore | 362/105 |
| 4,506,317 | A * | 3/1985 | Duddy | 362/396 |
| 4,533,982 | A * | 8/1985 | Kozar | 362/183 |
| 4,740,874 | A * | 4/1988 | Wylie et al. | 362/268 |
| 4,967,323 | A * | 10/1990 | Johnson et al. | 362/103 |
| 5,573,329 | A * | 11/1996 | van Gennep | 362/191 |
| 5,615,920 | A * | 4/1997 | O'Kane et al. | 294/65.5 |
| 5,934,223 | A * | 8/1999 | Ellery-Guy | 119/702 |
| 6,158,876 | A * | 12/2000 | Birdwell | 362/208 |
| 6,186,638 | B1 * | 2/2001 | Chang | 362/119 |
| 6,601,967 | B1 * | 8/2003 | Zeller | 362/116 |
| 6,619,813 | B1 * | 9/2003 | Schnell | 362/116 |
| 6,669,353 | B2 * | 12/2003 | Kung | 362/191 |
| 6,736,531 | B2 * | 5/2004 | Wallach | 362/414 |
| 2003/0227773 | A1 * | 12/2003 | Yang | 362/199 |
| 2003/0231491 | A1 * | 12/2003 | Shih | 362/199 |

* cited by examiner

*Primary Examiner*—Sandra O'Shea
*Assistant Examiner*—Hargobind S. Sawhney
(74) *Attorney, Agent, or Firm*—Colin P. Abrahams

(57) ABSTRACT

An articulated illumination device includes an elongated holding sleeve with one end threadably attached to a support body or base which communicates with an iron slug in an interior storage compartment for insertably receiving and magnetically holding the device. The storage compartment insertably receives a magnetic end of the illumination means that is releasably engageable with the iron slug and a battery-operated light is disposed at the other light or end. A universal joint includes a ball socket and joint formed in the support body or base for rotatably mounting a selected end of the illumination device. A magnet is intended to either attach to the support body or base by magnetic attraction to the iron slug when the illumination means is in the storage compartment or the magnet is employed for supporting the illumination means in a cantilevered position from a wall surface, a post or the like. The socket of the universal joint includes an open slot so that a shank carrying the ball permits the illumination means to rotate 90° from the longitudinal axis of the illumination means. A plurality of miniature accessory items may be carried in the holding sleeve when the illumination means has been withdrawn from the storage compartment. The holding sleeve may insertably receive and magnetically retain and store such items as a pen, tool kit, luggage tag or the like.

12 Claims, 4 Drawing Sheets

10
22
20
23
26
25
24
27
13
14
16
15
11
12
17
21

30
28

ARTICULATED LIGHT

Priority claimed on Ser. No. 60/407,801 filed Sep. 4, 2002.

BACKGROUND OF THE INVENTION

1. Field of the Invention

The present invention relates to the field of portable illumination devices, and more particularly to a novel illuminating means having a light carried at one end and a support body member coupled to its opposite end by means of an universal joint, and which further includes a magnet, a suction cup, clip or the like on the support body for releasably securing the illuminating means to a supporting structure such as a pocket key ring, a holder cartridge, storage sleeve, wall surface, or the like.

2. Brief Description of the Prior Art

In the past, it has been the conventional practice for a person to employ a pocket light or flashlight to illuminate a specific area in order to visually observe an object or in the performance of conducting a particular procedure. Such illumination means are generally bulky and, when in use, require that the illumination means be held in one hand permitting the person to use his or her other hand in the performance of the procedure. Should two hands be required, the person generally employs a separate stand of some kind for supporting the illumination means so that both of the user's hands are free to perform the procedure or to be used in connection with observing an object. Such a stand is separate from and independent of the illumination device itself and requires either permanent fixture to a wall, post or other support structure or the stand must be stored in a storage area until time for use, which takes up space and requires additional expense.

These problems and difficulties are due primarily to the fact that the illumination means or device does not incorporate an integral mount for supporting the illumination means or device from any one of a variety of available structures or portable holders, such as a wall surface, post, cartridge, or the like. Also, conventional holders or supports for illumination means or devices are generally fixed in one position or require multiple components for movable mounts, which complicate not only structure construction and assembly but maintenance procedures as well. Also, a separate coupling means is required for detachably connecting the illumination means or device to a separate and independent stand in order to support the illumination means or device in a fixed position.

Therefore, a long-standing need has existed to provide an illumination means or device having an integral mounting construction for detachably connecting the means or device to a support structure, whereby the support structure may take the form of a portable storage holder, case or sleeve, or to a stationary structure such as a wall or post. Preferably, the illumination means is detachably mountable to the support structure by a connection, such as a magnetic coupling, so that the illumination means can readily be removed from the structure or holder and detachably reconnected to another supporting structure. As a portable holder, accessory items such as pens, small tool implements or even luggage tags may be removably carried in a storage compartment of the storage holder or sleeve.

SUMMARY OF THE INVENTION

Accordingly, the above problems and difficulties are avoided by the present invention which provides an articulated illumination device which includes an elongated holding sleeve with one end threadably attached to a support body or base which includes a magnetic arrangement communicating with an interior storage compartment for insertably receiving and retaining the device. The storage compartment insertably receives one end of the illumination means having a magnet releasably engageable with an iron slug or the support body. A battery-operated light is disposed at the other end. A universal joint includes a socket formed in the support body or base for rotatably mounting a ball outwardly projecting from the illumination device. The magnet is intended to either attach to the support body or base by attraction to the iron slug when the illumination means is in the storage compartment or the magnet is employed for supporting the illumination means in a cantilevered position from a wall surface, a post or the like. The universal joint socket includes an open slot so that a shank carrying the ball permits the illumination means to rotate 90° from the longitudinal axis of the illumination means. However, a plurality of miniature accessory items may be carried in the holding sleeve when the illumination means has been withdrawn from the storage compartment. The holding sleeve may insertably receive and store such items as a pen, tool kit, luggage tag or the like.

It is to be understood that the support body or base may be a support member which constitutes a portion of a pocket item, such as a key ring assembly or the like, that can be releasably attached to any supportive surface by magnetic attractive force and which permits full articulation of the illumination means with respect to the support body or base.

Therefore, it is among the primary objects of the present invention to provide a novel articulated light source with a magnetic base so that the light can be stored in a holding sleeve by magnetic force and when withdrawn from the holding sleeve, the magnetic means can mount the illumination means to an appropriate supporting structure.

Another object of the present invention is to provide a magnetic mount for an illumination means connected by a universal joint so as to permit full articulation of the illumination means with respect to a supporting structure.

A further object resides in providing a portable holding sleeve for releasably and insertably storing a selected item chosen from a plurality of miniature accessory items which employs magnetic coupling of the selected item with the holding sleeve.

Yet another object of the invention is to provide a magnetic mounting means for releasably connecting an illumination means or device to a storage holding sleeve or, when withdrawn therefrom, permits magnetic connection with a supporting structure, such as a wall, post or the like.

Still a further object resides in providing a ball and socket universal joint interconnecting one end of an illumination means with a support body or base so that the illumination means may be rotated to project a light beam in a desired direction and which will accommodate rotation to permit a 90° deployment of illumination means and light beam with respect to the support body or base.

A further object resides in a novel storage and support means for detachably holding an illumination device in a portable storage holder and employing a magnetic engagement means for releasably retaining the illumination device in the storage holder or, when detached therefrom, for releasably retaining the illumination device on a supporting structure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENTS

Figures 1, 2, 3, 4:
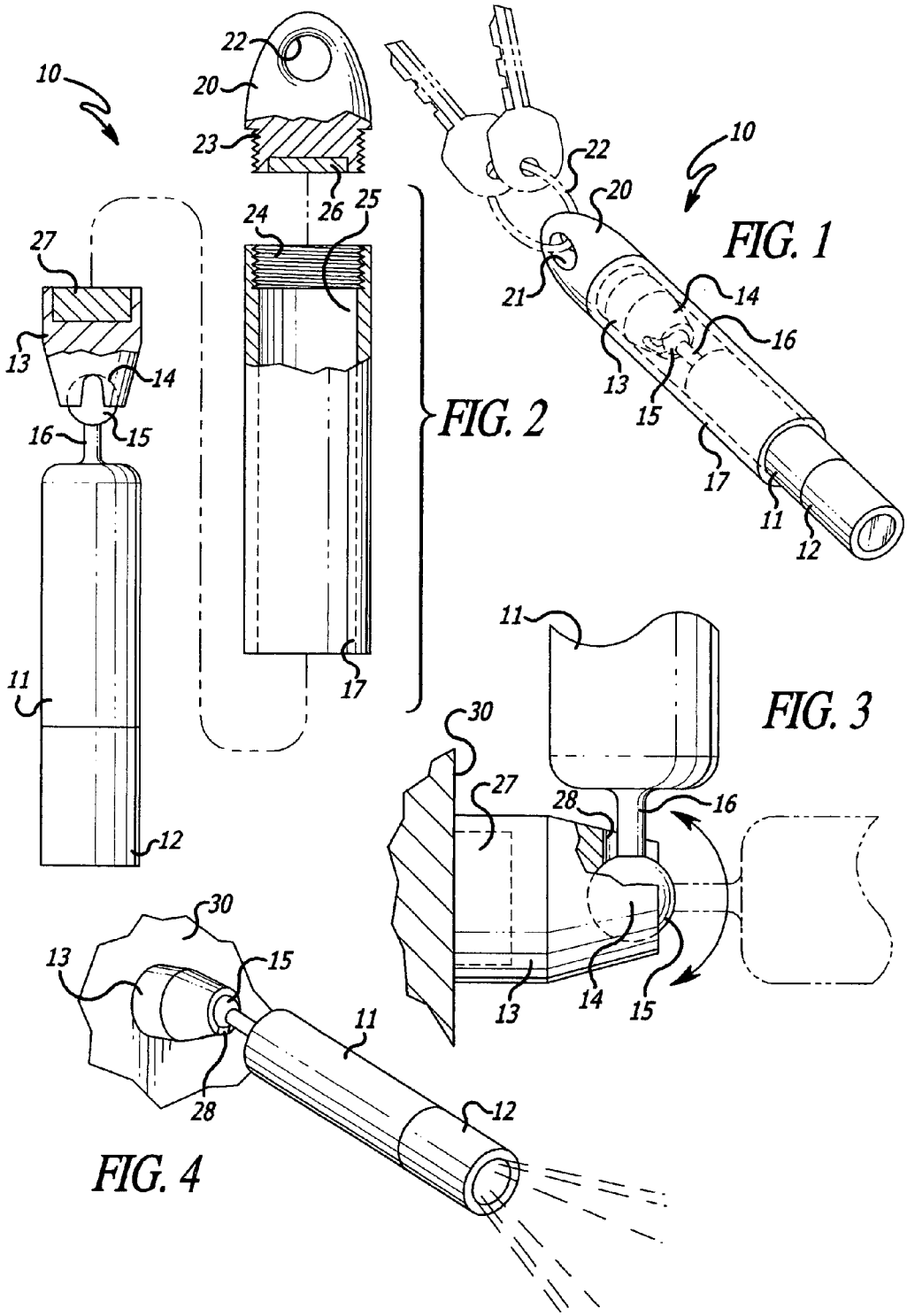
FIG. 1 is a front perspective view showing the novel articulated light with magnetic base incorporating the present invention in its portable position.
FIG. 2 is an exploded side elevational view, partly in section, of the articulated light illustrated in FIG. 1.
FIG. 3 is an enlarged, fragmentary side elevational view showing the articulated light in a first position in broken lines and in a second position in solid lines.
FIG. 4 is a front perspective view illustrating the novel articulated light in its fixed cantilevered position on a supporting structure.

Referring to FIG. 1, the novel articulated illumination means incorporating the present invention is illustrated in the general direction of arrow 10 and the illumination means is in a first position, which may be referred to as a storage and/or a carrying position. The illumination means per se includes a housing or body 11 having a light source and battery 12 disposed on one end of the body, as shown in solid lines, and a support body or member 13 carried on the other end of the housing, and identified in broken lines. The member 13 is connected to the housing 11 by means of a universal joint comprising a socket 14 into which a ball 15 is mounted. The ball 15 is carried on the end of a shaft or shank 16 which is fixed to the end of housing 11.

It is to be particularly noted that the illumination means is in a carrying or storage position wherein the device is inserted into an open-ended bore formed in a sleeve holder 17. Secured to the end of sleeve holder 17 is a base element 20 that includes an eyelet or loop 21 serving as an attachment means for an accessory, such as a key ring, identified by numeral 22. It is to be understood that any type of accessory can be detachably secured to the base element 22.

Referring now in detail to FIG. 2, it can be seen that the base element 20 includes external threads 23 which are threadably received by the internal threads 24 located at one end of the bore 25 in the sleeve 17. It is important to note that the end of base element 20 includes a metal or iron slug 26 having an exposed face which is in communication with the bore 25 when the base element is threadably connected with the sleeve 17.

The illumination device which includes the illumination source 12, including a suitable source of power, carried on the end of body 11 and the support body 13 is illustrated preparatory for insertion into the open end of bore 25 so that the illumination device may be carried in a storage or transport condition. When inserted into the bore 25, it is to be particularly noted that support body 13 includes a magnet 27 that magnetically engages with the slug 26 to provide releasable retention of the illumination device within the bore 25 of the sleeve 17. As illustrated in FIG. 1, the illumination means 12 outwardly projects from the end of holder sleeve 17 and the illumination source may be operated in this position by the user so that a beam of light outwardly projects from the illumination means while in the sleeve holder 17. In this position, the illumination means is hand-carried and the beam of light projecting therefrom may be directed to any object, surface or area intended to be observed.

Referring now in detail to FIG. 3, it is to be noted that the illumination device has been removed from the sleeve holder 17 and the magnet 27 carried on the support body or member 13 is magnetically attached to a wall surface 30 so that the illumination means cantilevers outwardly as illustrated in broken lines. However, the support body 13 further includes a slot 28 which will accommodate rotation of the ball 15 within socket 14 so that the shank 16 will permit the illumination means to be deployed normal to a central longitudinal axis of a support member or in other terms, in a position where the longitudinal axis of the illumination means is parallel to the wall surface 30. Therefore, it can be seen that the illumination means is fully articulated with respect to the support body or member 13 and can be deployed by the user to direct the light beam to any particular location. The hands of the user are now free to perform any particular procedure or activity with the light beam in a fixed position. The support body or member is stationary and the illumination means can be adjusted to any desired position by the user.

Referring now to FIG. 4, it can be seen that the illumination means is directed accordingly by the user and that the support body or member 13 is fixed to a supporting surface or structure 30. The illumination means may be manually deployed into any desired direction, such as to the right, left, up, down or any combination of direction. The slot 28 in the support body or member 13 can also be arranged with respect to the surface 30 so that the light beam can be directed to any particular location desired by the user. It is to be understood that the illumination means is included in the housing 11 and/or means 12, whereby focusing, culminating or diffusion of the light beam may be achieved by rotating the illumination source 12 with respect to the housing 11. The illumination source is battery operated so that the device is fully portable and operable at the selection of the user. The illumination bulb, batteries and circuitry, including an on/off control, is not a part of the present invention, other than as employed with the support body or member, holder and universal connection therewith.

Furthermore, the support body 13 may be releasably attached to a supporting surface by other means than by magnetic attraction. For example, the support body may employ a suction cup, a resilient clip for waist belt attachment, or the like.

Figures 5, 6:
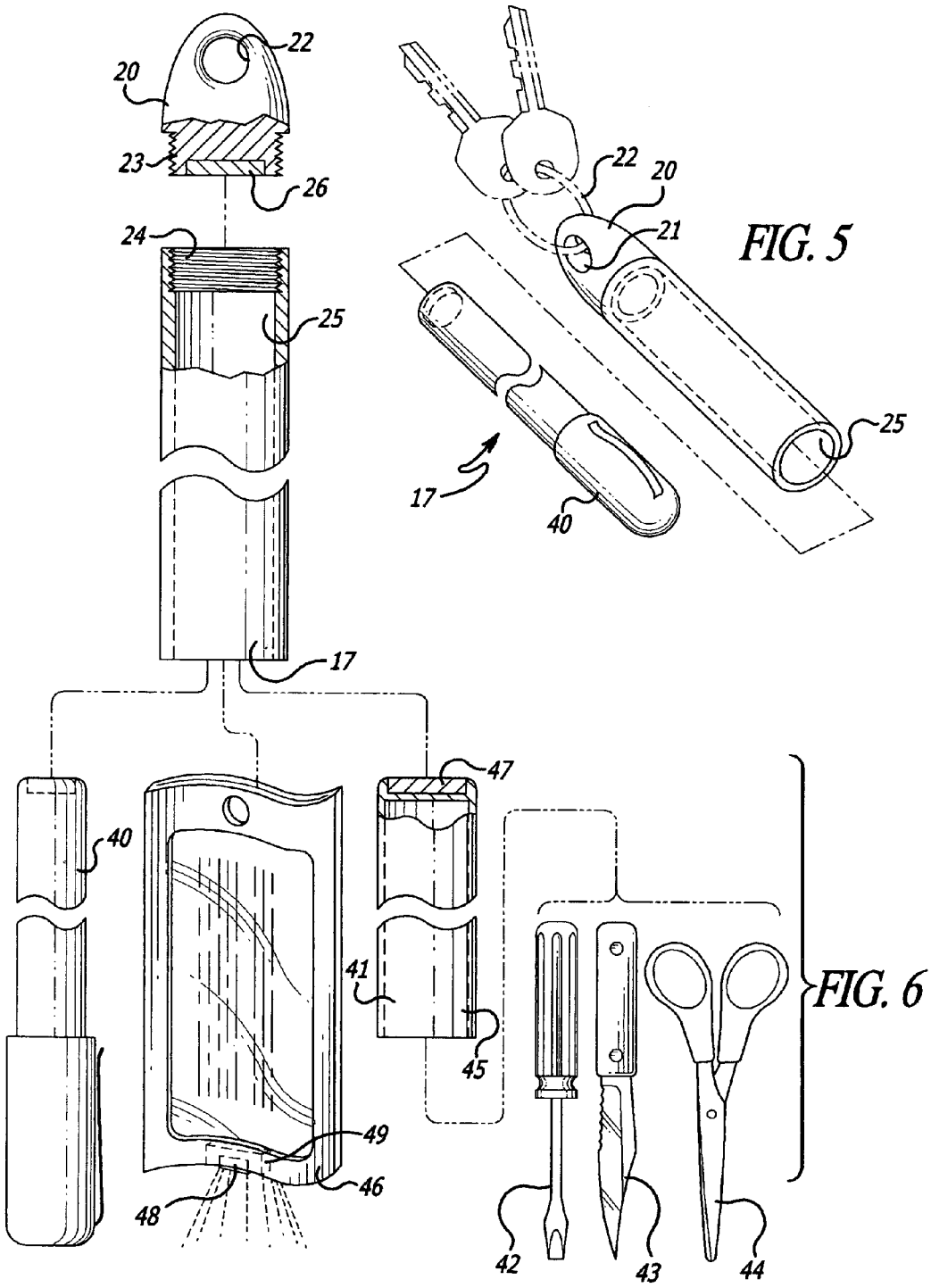
FIG. 5 is a perspective view, similar to the view of FIG. 1, illustrating the portable holding sleeve preparatory for insertably receiving a selected accessory item.
FIG. 6 is an exploded side elevational view, partially in section, showing the portable holding sleeve adapted to releasably store any one of a plurality of accessory items.

In FIGS. 5 and 6, it can be seen that the holder, or holding sleeve 17, may be utilized to house or store other accessory items than the illuminating means 12. Such items may be selected from a plurality of items as a writing pen 40, a tool kit 41, having implements 42, 43 and 44, held in a compartment 45 or even a luggage tag 46 with light 49.

FIG. 5 illustrates the pen 40, for example, in position for insertion into bore 25 of the holding sleeve 17. The bore is open at its terminal end, and the body of the pen may include a magnet for attraction with the metal slug 26. However, the holding sleeve 17 may have a magnet in place of the slug 26, whereby the metal pen body, or slug in the pen body, is attracted to the magnet for releasable retention. The kit 41 may incorporate a magnet 47 for attracting the slug 26, or the slug may be secured in the kit with a magnet fixed in the support body or base 20. For a luggage tag 46, the shape of the holding sleeve must be conformed with the shape and size of the tag. Magnetic attraction for the tag with holding sleeve is the same as previously described.

In view of the foregoing, it can be seen that the illumination means, or a selected accessory item, may be carried in the sleeve holder 17 as part of an accessory assembly, such as a key ring, and that the holder can be carried in a purse, pocket, or may even be clipped onto a belt. In its portable condition, the illumination means, or accessory item, is inserted into the bore 25 of the sleeve holder 17, as illustrated in FIG. 1 or FIG. 5, or alternately, the illumination means, or the accessory item, can be removed from the holder and detachably connected in a fixed position onto a surface, such as wall 30.

Figure 7:
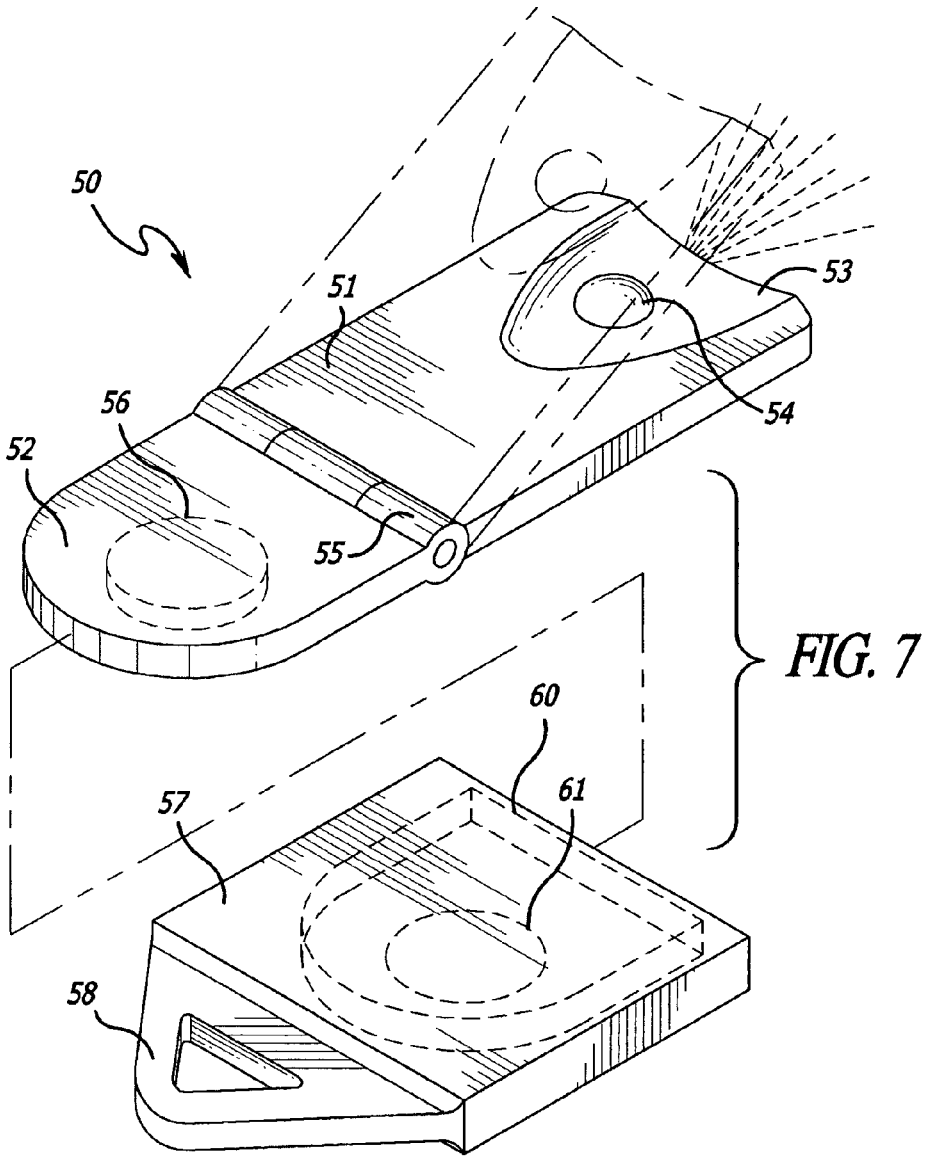
FIG. 7 is an exploded perspective view showing another version of an articulated light.

Another embodiment of the articulated light is illustrated in FIG. 7 in the direction of arrow 50 that includes a housing or body 51 pivotally supported on a base 52 having an attachment device such as magnet 56. The housing 51 includes a light assembly 53 operated by a push-button 54. The housing is pivotally carried on the base 52 by a hinge mechanism 55. The base is insertably received into a holder 57 having an open-ended cavity 60, shown in broken lines, and is releasably retained therein by mating of a metal slug 61 with the magnet 56. Reversing of the magnet and slug is also envisioned by the present invention. The holder 57 may include an eyelet 58 for attaching with a key chain or other accessory. When a magnet or two magnets or other securement device are employed on the holder, the holder may be releasably mounted on a metal supporting structure.

Figure 8:
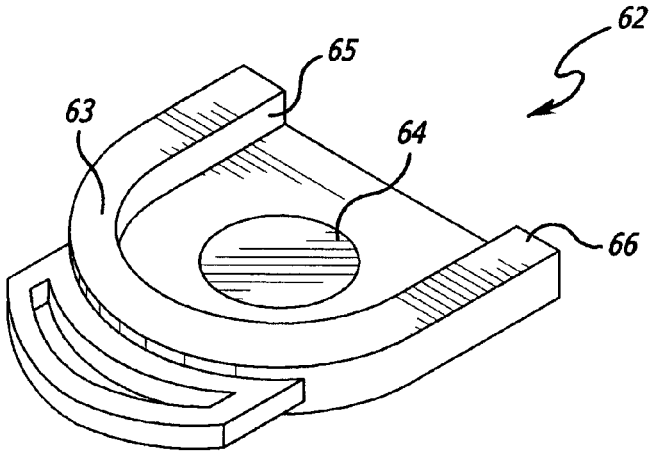
FIG. 8 is a perspective view of another version of a support body or base for the illumination device.

FIG. 8 shows an alternate holder 63 for receiving the base 52 in the direction of arrow 62. The holder 63 includes an open cavity defined between sidewalls 65 and 66 into which the body 52 is inserted. A magnet 64 (or slug) attracts the slug (or magnet) disposed on the body 52 for releasable retention.

Figure 9:
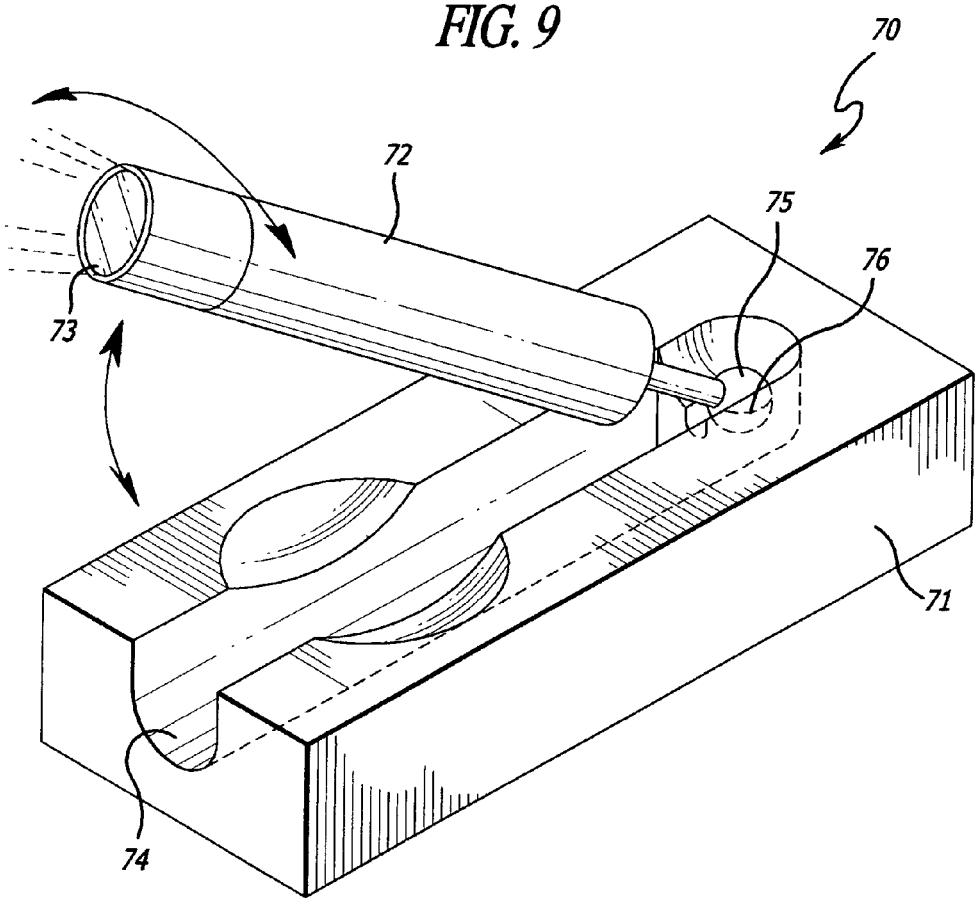
FIG. 9 is a perspective view of still another version of an articulated illumination device.

In FIG. 9 another version is shown in the direction of arrow 70 having a base 71 with an elongated slot 74 occupied by a housing 72. One end of the housing includes a light assembly 73 while its opposite end includes a ball 75 movably mounted in a socket 76 to provide a universal joint. A shank 77 connects the ball with the end of the housing and depressions or recesses 78 and 79 serve as finger grasping cavities for gripping the housing and moving it to a desired position.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An articulated illumination device comprising:

a holding sleeve having an internal storage compartment;

an illumination means insertably received in said storage compartment;

attachment means cooperatively carried on said illumination means and said holding sleeve for releasably attaching said illumination means to said holding sleeve;

said illumination means includes an elongated body having a light source;

a support body carrying a portion of said releasable attachment means;

a universal joint coupling said elongated body with the support body;

said universal joint includes a ball carried by said elongated body and a socket carried on said support body rotatably mounting said ball therein;

said elongated body includes a shank terminating in securement with said ball holding said ball in fixed spaced-apart relationship with respect to said elongated body;

said support body having a central longitudinal axis and further having a slot for receiving said shank to permit said illumination means to be deployed normal to said central longitudinal axis; and said attachment means is magnetic with a first element of attraction disposed on said elongated body and a second element of attraction disposed on said support body.

2. The device defined in claim 1 wherein:

said attachment device includes a magnet fixed on said support body; and a metal plate fixed on said holding sleeve.

3. The device defined in claim 2 wherein:

said universal connector includes a ball and socket arrangement permitting said illumination means to be rotatable and deployable normal to a central longitudinal axis of said support body.

4. The device defined in claim 3 wherein:

said internal storage compartment and said illumination means are conformal in shape and size so as to accommodate storage in said holding sleeve.

5. An articulated illumination device comprising:

an illumination means having an elongated body terminating at one end with an adjustable light source;

a support body provided with an attachment device for releasably securing said support body to a supporting structure;

a universal connector rotatably joining said elongated body to said support body;

said attachment device employs a magnetic attraction force field; and said supporting structure is a holding sleeve having an internal storage compartment for insertably receiving and storing said illumination means and said support body.

6. The device defined in claim 5 including:

an attachment arrangement carried on said support body for detachably securing said support body and said elongated housing on a supporting structure.

7. The device defined in claim 6 wherein:

said attachment arrangement includes at least one magnetically attractive element carried on said support body.

8. The device defined in claim 7 including:

a key ring attachment arrangement provided on said support body; and said housing having a pocket clip.

9. An articulated illumination device comprising:

an elongated body terminating at one end with a light source and terminating at an other end with a connector rotatably joined at the other other end;

a support body releasably attached to said connector;

an attachment means operable for releasably securing said support body with said connector of said elongated body wherein said attachment means employs a magnetic attraction force field; and said support body having a cavity defining a storage compartment for insertably receiving and storing said connector and said elongated body with said light source.

10. The articulated illumination device defined in claim 9 wherein:

said releasable attachment means including a first element of attraction disposed on said connector and a second element of attraction disposed on said support body.

11. The articulated illumination device defined in claim 10 wherein:

said elongated body is a flat base having a recess with said illumination means carried in said recess; and a hinge coupling said other end of said elongated body with said connector whereby said connector rotates about a horizontal axis with respect to said base.

12. The articulated illumination device defined in claim 11 wherein:

said support body includes parallel sidewalls separated by said cavity for guiding said connector into said cavity during insertion thereof.

* * * * *